US007132941B2

(12) United States Patent
Sherlock

(10) Patent No.: US 7,132,941 B2
(45) Date of Patent: Nov. 7, 2006

(54) SYSTEM FOR MONITORING AN ENVIRONMENT

(76) Inventor: Charlie Sherlock, 6 Luttrellstown Grove, Cateleknock Dublin (IE), 15

( * ) Notice: Subject to any disclaimer, the term of this patent is extended or adjusted under 35 U.S.C. 154(b) by 291 days.

(21) Appl. No.: 10/668,093

(22) Filed: Sep. 19, 2003

(65) Prior Publication Data

US 2004/0059438 A1 Mar. 25, 2004

(30) Foreign Application Priority Data

Sep. 20, 2002 (IE) ..... S2002/0758

(51) Int. Cl.
*G08B 1/08* (2006.01)

(52) U.S. Cl. ..... 340/539.26; 340/693.9; 340/545.1; 340/545.6; 340/545.9; 340/547; 340/686.1

(58) Field of Classification Search ..... 340/539.26, 340/693.9, 545.1, 545.6, 545.9, 547, 686.1
See application file for complete search history.

(56) References Cited

U.S. PATENT DOCUMENTS 4,367,458 A * 1/1983 Hackett ..... 340/539.16
5,225,806 A * 7/1993 Stanley-Arslanok et al. ..... 340/541
6,057,764 A 5/2000 Williams
6,411,209 B1 * 6/2002 Lyons et al. ..... 340/541
6,472,993 B1 * 10/2002 Addy ..... 340/686.1
6,658,091 B1 * 12/2003 Naidoo et al. ..... 379/37

FOREIGN PATENT DOCUMENTS

EP 1 071 055 B1 12/2004
GB 2 194 089 A 2/1988

* cited by examiner

*Primary Examiner*—Tai T. Nguyen

(57) ABSTRACT

A system for monitoring an environment comprises a plurality of sensors, each sensor generating respective events in response to activity in the environment. A processor is in operative association with the sensors, and at least one stored set of linked events are accessible to the processor. The processor is responsive to an event being generated by a sensor to determine whether the event is in a sequence of events corresponding to a stored set of linked events and to generate an alarm accordingly.

15 Claims, 2 Drawing Sheets

| # | ITEM NAME | # | ITEM NAME | # | ITEM NAME |
|---|---|---|---|---|---|
| 10 | SYSTEM | 12 | PROPERTY | 40 | EXTERNAL MONITORING STATION |
| 14-1 | PROCESSOR | 16-1 | MOTION/HEAT SENSOR | 18-1 | CONTACT SENSOR |
| 14-2 | PROCESSOR | 16-2 | MOTION/HEAT SENSOR | 18-2 | CONTACT SENSOR |
| 14-3 | PROCESSOR | 16-3 | MOTION/HEAT SENSOR | 18-3 | CONTACT SENSOR |
| 14-4 | PROCESSOR | 16-4 | MOTION/HEAT SENSOR | 18-4 | CONTACT SENSOR |
| 20-1 | CONTACT SENSOR | 26-1 | WINDOW | 28-1 | INTERIOR DOOR |
| 20-2 | CONTACT SENSOR | 26-2 | WINDOW | 28-2 | INTERIOR DOOR |
| 20-3 | CONTACT SENSOR | 26-3 | WINDOW | 28-3 | INTERIOR DOOR |
| 20-4 | CONTACT SENSOR | 20-4 | WINDOW | 28-4 | INTERIOR DOOR |
| 30-1 | ROOM 1 | 30-3 | ROOM 3 | 22-3 | KEYPAD |
| 30-2 | ROOM 2 | 30-4 | ROOM 4 | | |

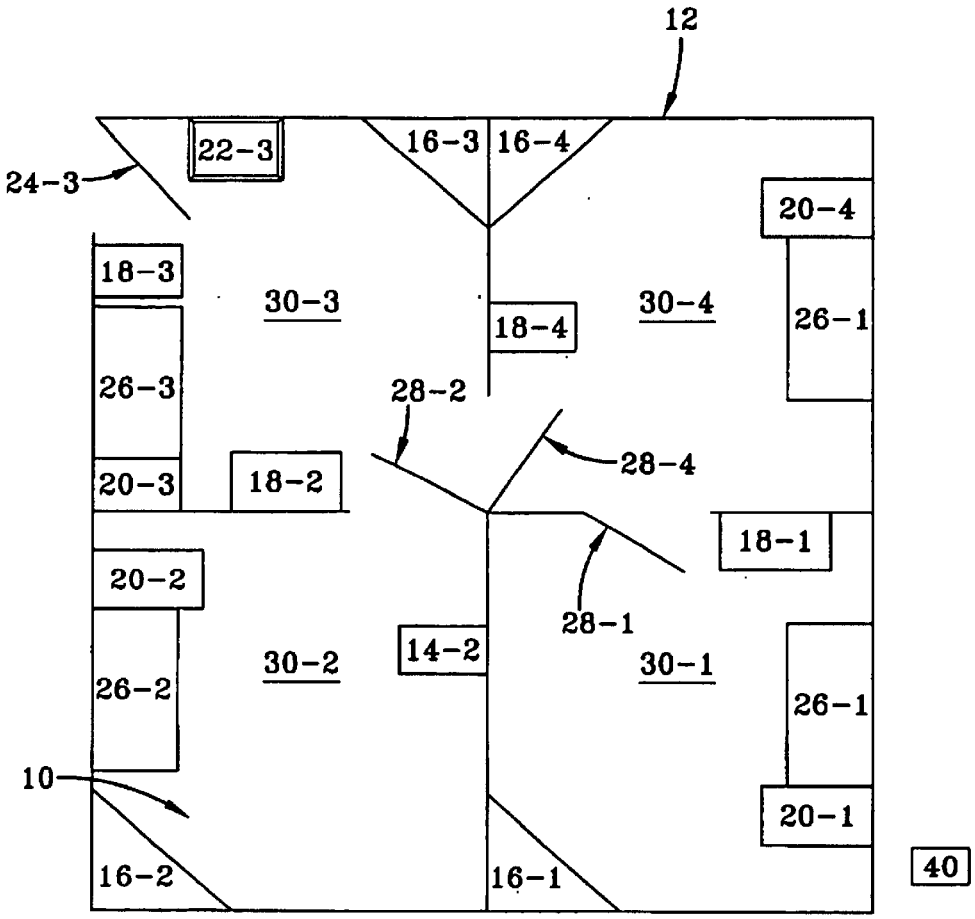

| # | ITEM NAME | # | ITEM NAME | # | ITEM NAME |
|---|---|---|---|---|---|
| 10 | SYSTEM | 12 | PROPERTY | 40 | EXTERNAL MONITORING STATION |
| 14-1 | PROCESSOR | 16-1 | MOTION/HEAT SENSOR | 18-1 | CONTACT SENSOR |
| 14-2 | PROCESSOR | 16-2 | MOTION/HEAT SENSOR | 18-2 | CONTACT SENSOR |
| 14-3 | PROCESSOR | 16-3 | MOTION/HEAT SENSOR | 18-3 | CONTACT SENSOR |
| 14-4 | PROCESSOR | 16-4 | MOTION/HEAT SENSOR | 18-4 | CONTACT SENSOR |
| 20-1 | CONTACT SENSOR | 26-1 | WINDOW | 28-1 | INTERIOR DOOR |
| 20-2 | CONTACT SENSOR | 26-2 | WINDOW | 28-2 | INTERIOR DOOR |
| 20-3 | CONTACT SENSOR | 26-3 | WINDOW | 28-3 | INTERIOR DOOR |
| 20-4 | CONTACT SENSOR | 20-4 | WINDOW | 28-4 | INTERIOR DOOR |
| 30-1 | ROOM 1 | 30-3 | ROOM 3 | 22-3 | KEYPAD |
| 30-2 | ROOM 2 | 30-4 | ROOM 4 | | |

FIG-1

SYSTEM FOR MONITORING AN ENVIRONMENT

FIELD OF THE INVENTION

The present invention relates to a system for monitoring an environment. Particularly preferred embodiments of the invention provide a security system which discriminates between authorised and unauthorised individuals, and which is operable to generate an alarm upon the detection of event triggered by an unauthorised individual.

BACKGROUND OF THE INVENTION

Despite significant technological advances in recent years, domestic and business security systems have retained the same operating principles over the past decade and a half. In a typical domestic security system, all entry points are monitored by means of magnetic, vibration, or a combination of these sensors. The sensors are wired or radio linked to a central control unit. In addition, the system may be provided with passive infrared (PIR) or ultrasonic sensors deployed within the property or premises, which offer an additional level of protection. Such sensors detect movement within the particular area covered by the sensor. Different locations within the property will have different zones assigned thereto, for example zone 1 may be downstairs, while zone 2 may be upstairs. This allows the user some control over which parts of the property are armed at any given time. User control is generally facilitated by a standard key pad interface, which is normally located away from the main control unit at the main entrance point to the property or premises. Panic alarms, battery back up, trip switches, fire sensors, video monitoring and dial up links to a centralised security monitoring centre all form constituent parts of standard modern alarm systems.

However, there are a number of significant problems with such alarm systems of the prior art. Current systems rely on either the opening or forced entry through an entrance of the property in order to detect an intruder. Present systems will not alert the user if someone enters the property through an open window or door. In addition, unless the alarm system is manually switched on, and armed for a particular zone, in general, it is does not generate alarms. Furthermore, if a monitoring station is employed, the alarm system will only dial same if an alarm is generated, and is thus inoperable once the occupant returns to the premises and disables the alarm. Such monitoring stations are also typically connected to the alarm system by a standard fixed or land line connection, which is easily disabled.

Current security systems do not track the movement of people within a property. This severely limits the capability of the system to discriminate between unauthorised and unauthorised entry into the property, and also means that critical information cannot be passed on, for example informing rescue authorities as to the number and position of people within a property when a fire is detected.

SUMMARY OF THE INVENTION

The present invention seeks to mitigate the problems of the prior art by providing a system for monitoring an environment, said system comprising:

a plurality of sensors, each sensor generating respective events in response to activity in said environment;

a processor in operative association with the sensors, and at least one stored set of linked events accessible to said processor, wherein said processor is responsive to an event being generated by a sensor to determine whether the event is in a sequence of events corresponding to a stored set of linked events and to generate an alarm accordingly.

BRIEF DESCRIPTION OF THE DRAWINGS

Embodiments of the invention will now be described, by way of example, with reference to the accompanying drawings, in which:

FIG. 1 illustrates a schematic view of the ground floor of a house in which the system of the present invention has been installed.

DETAILED DESCRIPTION

Figure 2:
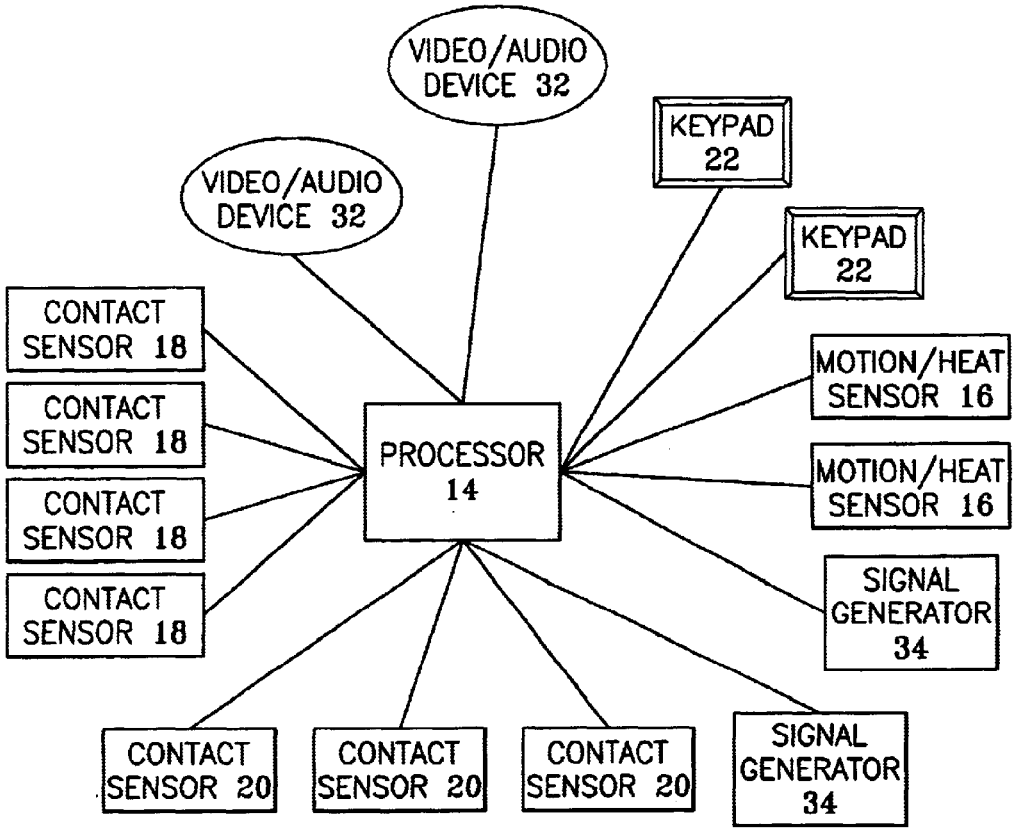
FIG. 2 illustrates a schematic view of the architecture of the system of the present invention.

Referring now to the accompanying drawings, there is illustrated a security system, generally indicated as 10, adapted to monitor an environment such as a premises 12 for the presence or activity of unauthorised individuals such as intruders or the like. The system 10 comprises a plurality of sensors of varying function, as will be described in detail hereinafter, and a processor 14 with which each of the sensors are in communication, either by remote or radio/IR connection, or any other suitable means.

For the purposes of the following description, the premises 12, as illustrated in FIG. 1, is represented by the ground floor of a two storey domestic property, although it will of course be appreciated that the premises 12 may be of any other variety, for an example an office block or warehouse, etc and may even include sensors for monitoring external events. The premises 12 includes a number of rooms 30-1 . . . 30-4, an exterior door 24-3, interior doors 28-1, 28-2 & 28-4 connecting adjacent rooms 30, and a number of windows 26-1 . . . 26-4. Each room 30 is provided with one or more from a variety of sensors, in the present case:

a motion/heat sensor 16-1 . . . 16-4 arranged to fully cover the area of the respective room 30;

a contact sensor 18-1 . . . 18-4 in operative association with each door 24, 28, and operable to determine when the respective door 24, 28 has been opened or closed; and a combined contact/vibration sensor 20-1 . . . 20-4 in operative association with each window 26, and operable to determine when the window 26 has been opened or closed.

A keypad 22-3 is also provided preferably adjacent the exterior door 24-3, through which the user enters a PIN (personal identification number) or access code.

Each movement/heat sensor 16 is preferably of the passive infrared (PIR) or ultrasonic type, although it will be appreciated that any other suitable equivalent may be used. Each contact sensor 18 is preferably of the magnetic type, although again any other suitable alternative may be used. The plurality of contact/vibration sensors 20 are preferably a combination of magnetic and vibration sensors, although the person skilled in art will understand that any alternative may be supplemented therefore. It will furthermore be understood that each room 30 shown, due to the shape thereof, requires only a signal movement/heat sensor 16 to cover the entire area of the room 30. However, any given area to be monitored by the system 10 may require more than one motion/heat sensor 16, due to the shape and/or size of the area in question. It will be seen that any suitable mechanism corresponding to a keypad for authenticating an authorised individual can be employed including for example, biometric systems based on fingerprint or voice pattern recognition or even inference based systems which passively identify individuals through behaviour patterns.

Thus, each of the above mentioned sensors 16, 18, 20, 22 is connected to the processor 14, which constantly monitors the information provided by each sensor 16, 18, 20, 22.

It will be seen that in relation to the sensors deployed across the premises, the above arrangement is conventional.

However, in the prior art, the keypad 22-3 is used to authenticate an individual who is trying set the armed state of the monitoring system, for example, standby mode, part-armed or fully armed. On entry into the premises 12 usually through the designated external door 24-3, a user will be given a timed period within which to enter a PIN and so disarm the system. Before exiting, the user selects an armed option via the keypad and is given a timed period within which to exit the premises again through a designated external door.

Such prior art systems respond to sensor events usually only in accordance with the armed state of the system. So in standby mode, as explained above, unauthorised or unauthenticated access to the premises does not generate an alarm. However, events such as disconnection of the mains supply or short-circuiting of a sensor may cause an alarm in spite of there being a good reason for such events such as maintenance being performed by an authorised service technician.

By contrast, in the preferred embodiment, the keypad 22-3 or any other such authenticating sensor, enables the processor 14 to determine the presence and location of an authorised individual. By entering an authentic PIN or the like into the keypad 22, the authorised individual alerts the processor 14 to the fact that the individual is authorised to be in the premises 12 at least to some extent. The processor 14 is programmed to permit such authorised individuals to move within the environment and to generate system events via the sensors 16, 18 and 20. At the same time, the system 10 is designed to constantly monitor the premises 12 for the presence of an intruder or an unauthorised individual, even though the authorised individual may be present on the premises 12.

As will be described in more detail, the system 10 need not have a specifically armed state but instead remains active and tracks the presence of authorised individual throughout the premises 12 without generating an alarm. However, if an unauthorised individual enters the premises 12, the system 10 detects their presence and generates a suitable alarm.

In the preferred embodiment, the processor 14, rather than being composed of the conventional array of solid state electronic components and switches, is operated by dedicated software which is capable of performing complex monitoring and programming tasks, as will be described hereinafter.

In the preferred embodiment, the processor 14 has programmed therein or accessible thereto either in permanent storage or in memory a map of the premises 12 linking events generated by the sensors 16, 18, 20 and 22 logically. Through this linkage, the system tracks the location and movement of an individual throughout the premises 12.

For example, a stored set of linked events could comprise, in sequence:

the contact sensor 18-3 opening, the movement sensor 16-3 detecting movement, entry of an authentic PIN on the keypad 22-3, the contact sensor 18-2 opening, the movement sensor 16-2 detecting movement, and the contact sensor 20-2 opening.

A stored set of linked events may be complex or dendritic in structure with optional and time related events in the sense that a stored set of linked events might comprise:

the contact sensor 18-3 opening between the hours of 5am to 11pm, the movement sensor 16-3 detecting movement, mandatory entry of an authentic PIN on the keypad 22-3 within 30seconds of the contact sensor opening, optionally the contact sensor 18-2 opening, the movement sensor 16-2 detecting movement, and the contact sensor 20-2 opening within 10 minutes of the movement sensor 16-2 detecting movement, or optionally the contact sensor 18-4 opening, the movement sensor 16-4 detecting movement, b)(I) the contact sensor 20-4 opening within 10 minutes of the movement sensor 16-4 detecting movement, or b)(II) optionally the contact sensor 18-1 opening, the movement sensor 16-1 detecting movement and the contact sensor 20-1 opening within 10 minutes of the movement sensor 16-1 detecting movement, or the contact sensor 20-3 opening within 10 minutes of the movement sensor 16-3 detecting movement.

It will be seen that each of the above sets of linked events includes the entry of a PIN on the keypad 22-3—an authenticating event occurring on an authorising sensor.

If an event is triggered by a sensor, the processor is programmed to determine whether that event is linked to events generated by other sensors and if these events match all [or at least the required/mandatory parts] of at least one set of the stored set of linked events, no alarm is generated.

For example, if an individual enters the premises 12 via the exterior door 24-3, the associated contact sensor 18-3 triggers a signal which is read by the processor 14, thereby alerting the processor 14 to the possible entry of an individual at the exterior door 24. The motion/heat sensor 16-3 in the room 30-3 containing the exterior door 24-3 will then detect heat/motion of the individual, which is also registered by the processor 14, confirming the presence of an individual. The individual then enters an authentic PIN on the keypad 22-3 within 30 seconds of entering the premises. If the individual then moves from the first room 30-3 to an adjacent room 30-2 or 30-4, via one of the interior doors 28-2 or 28-4 respectively, the associated contact sensor 18-2 or 18-4 will generate a signal upon the respective interior door 28 being opened, immediately indicating to the processor 14 which room 30 the individual is proceeding into. However, if the interior door 28 is already open, the motion/heat sensor 16 in the room 30 to which the individual proceeds will then pick up the heat/motion of that individual, and thus the processor 14 will in any event be aware that the individual has proceeded from one room 30 to the adjacent room 30. In this way the processor 14 is constantly updated as to the present location of the individual.

It will be seen from the above example, that as long as the user entered the premises between 5 am and 11 pm, the sequence of events matches the second sequence of the exemplary stored sets of linked events described above and in particular includes the mandatory event of entry of an authentic PIN. As such, the processor does not generate an alarm for this set of events.

In general, sets of linked events stored by the processor will include at least one authenticating event. However, if no authentication is required for an event to take place, then there is no requirement for such an event in a stored set of linked events. For example, a window may be designated as freely openable and so a single event may be stored by the processor corresponding to the opening of the window.

As indicated by the set of linked events above, this and other events may be time delimited.

In the case of the window opening event above, appropriate absolute timings can be stored with the event. So if the window is opened and a corresponding sensor reports this event to the processor, the processor matches the event with a single event stored set of linked events and if it were within a designated time associated with the event no alarm is generated.

It will also be seen that events may need to be linked with certain relative timing. Thus, each event in the stored set of linked events may have time limits associated with it. For example, if the processor detects the external door 24-3 opening, it may require that an authentic PIN be entered within 30 seconds.

If, for example, the above stored sets of linked events were the only stored events, it will be seen that, if another individual (an intruder) enters the premises 12 through the window 26-1 before the authorised individual had triggered the movement sensor 16-1 having travelled from the external door 24-3, the system 10 would not match this event within the sequence of other events that may have occurred to any stored set of linked events. The system would therefore immediately detect the presence of the intruder and thus the system 10 can generate a suitable alarm.

In addition to this basic function, the system 10 is capable of performing other monitoring tasks, which will be more clearly understood by use of the following examples.

EXAMPLE 1

The property 12 is initially empty, on arrival to the property 12 of the owner. Upon entering through the exterior door 24-3, the owner is prompted to enter their PIN or access code. Where more than one person lives in the property 12, each person may have their own personal code, for reasons which will become clear from the following examples. The owner enters their code on the keypad 22-3 and closes the exterior door 24-3. The system 10 registers their entry, identity, and, with the appropriate sensors or arrangement of sensors such as motion/heat sensor 16 in the first room (hallway) 30-3, records the fact that they are on their own. The person then proceeds to move through the property 12, with the system 10 tracking their movements at all times.

The person moves into the room 30-4 to the right of the first room 30-3 and opens the window 26-4 therein. As explained above, no alarm is generated as the system 10 detects that the authorised individual is in that room 30 and beside the window 26 when it is opened. This is because the opening of the contact 20-4 is matched through the previous sequence of events to a stored set of linked events. In any case, the system 10 writes this event to its system log.

After a period of time the person then closes the window 26-4, but in doing so they neglect to close the window handle correctly—so whilst the window is closed it is not physically secure. The system 10 records this action, and as it is linked to a series of linked events matching a stored set of linked events, no alarm is triggered. The system 10 writes this event to its system log.

The person then proceeds upstairs (not shown) to the main bedroom (not shown).

Unknown to the owner of the property 12, an unauthorised individual is approaching the property 12 through the rear garden (not shown). Seeing the unsecured window 26-4, the intruder forces the window 26-4 open and attempts to climb through into the room 30-4.

As mentioned above, for opening of the window contact 20-4 to be a permissible event, it may need to occur within a fixed timed period of the detection of movement by the sensor 16-4 which in turn was linked to a set of events matching a stored set of linked events.

The system 10 can thus prohibit entry through any window 26, whether open or not, as the window opening event occurred in isolation or out of sequence and therefore an alarm is immediately generated.

Alternatively, the windows 26 may have pairs of sensors 20 associated therewith. These sensors may be arranged to detect whether a window is being opened from the inside or the outside. Each pair of sensors may be associated with a respective stored set of linked events which need to occur in sequence. Again, these may be time delimited. This would mean that as long as a window were opened from the inside during the delimited times, these events would match an appropriate stored set of linked events and so not cause the processor to generate an alarm.

In the event of an alarm, several events may occur. The system 10 is connectable to an external monitoring station 40 which receives information transmitted from the system. For example, an audible alarm can be immediately generated, and a message sent via cellular link (not shown) forming part of the system 10, to a central monitoring station (not shown). The message can contain details of the precise entry point, and also of the fact that the owner of the property is currently in the main bedroom of the property 12. The Police can be immediately notified by a secure computer link.

Depending on the particular configuration of the system 10, a voice message may be announced via any suitable means (not shown), giving the position and number of intruders. This information will allow the owner to know where the intruders are located, thereby allowing them to take steps to protect their personal safety. The voice announcement will preferably sound only where there is an authorised individual already in the property 12.

Referring briefly to FIG. 2, the system 10 may be provided with video/audio devices 32 suitably located within the property 12, which devices 32, would, upon detection of an unauthorized individual, begin an audio/video recording of the intruder, tracking their movements throughout the property 12. Also shown in FIG. 2 are one or more signal generators 34 in operative association with processor 14 such that a signal can be provided to any authorized individual on the premises, detailing the location and/or number of unauthorized individuals in the premises.

The security monitoring centre can dial into the system 10 via the cellular link and monitor the locations of both the owner and the intruder. This information could then be continually fed to the Police, allowing them to be effective in their entry and containment of the intruder.

If, on hearing the alarm, the intruder vacates the property 12, this event is also noted to the system log, and the audible alarm will quieten or cease. Monitoring by the security station will continue, and phone contact be made by the station to the owner, in order to ensure their safety, and inform them of the location of the relevant authorities.

The audio/video images of the intruder may also be downloaded from the system 10, and provided to the Police or relevant authorities.

EXAMPLE 2

In this example, the property 12 is occupied by two owners (person A and person B), and their dog, which is downstairs. The occupants of the property 12 generally leave the interconnecting interior doors 28 open to allow the dog freedom to move throughout the property 12. Having tracked the occupants from their authenticated entry into the property and from movement sensor information, the security system 10 knows that the occupants are at present in the main bedroom (not shown), and that the dog is downstairs.

Person B gets up at 4.30 a.m. to use the bathroom (not shown). The system 10 detects this movement. Person B then proceeds to open the window of the main bedroom. No alarm is generated as the system 10 is tracking the movement of person B, and notes them opening the window—again this sequence of events matches a stored set of linked events as explained in Example 1. At 5.30 a.m. an attempt is made to gain entry to the property 12 by an intruder. The intruder forces the glass (not shown) out of the window 26 of one of the downstairs rooms 30. The intruder does this in such a way as to cause no vibration, thus ensuring that no signal is generated by the contact/vibration sensor 20 associated with the window 26. The dog is also asleep in this room 30 and is sleeping right below the window 26. The intruder is able to make entry into the property 12 without waking the dog.

In this example, a more sophisticated movement sensor 16 is employed. In particular, the sensor is capable of resolving the number of heat sources within its field of view and is able to make a determination about the number of people in a room. The motion/heat sensor 16 in the room 30 detects movement in the room. The system 10 is aware of the dog sleeping under the window 26, and the motion/heat sensor 16 detects movement from that area. At this point, the system 10 is not aware that the glass has been lifted out of the window 26. However, the motion/heat sensor 16 picks up the fact that there are now two separate heat sources in the room 30 and immediately sounds the alarm. This is because the event of an additional heat source being detected by the motion sensor 16 will not match a stored set of linked events where the number of bodies in the field of view of such sensors is taken into account.

The security monitoring actions taken are similar to the details in example 1 above.

EXAMPLE 3

The security system 10 continually monitors all occupants of the property 12, and tracks their movement and location. This ensures that occupants of the property are able to move freely within the property, opening doors 24, 28 and windows 26, without setting off the alarm.

Referring to the situation described in example 1 above, the owner may have a guest staying at the property 12. Their guest may wish to enter or leave the property 12 on their own. In order to allow this, without divulging their own personal code, the owner sets the security system to allow their guest to come and go as they please, by setting them up with a time delimited access code. This could be achieved, for example, as follows. The owner enters their own access code, and selects the "guest access code" option from the menu on the keypad 22. The owner inputs the guests desired PIN (preferably twice) and then selects the "valid from/to" option from the menu. Person A sets the valid date range for the guest access code as appropriate.

This facility ensures that it is not necessary to disable the continuous operation of the system 10, while allowing the guest to have access to the property 12. This functionality may also be augmented by, for example, a "worker access code" which allows the user to input the specific hours of the day for which they want the worker code to be valid. If the worker/guest code is used outside of the valid hours/days then an immediate alarm will sound.

Such a worker access coder can also be useful for example when maintenance is to be performed on the system. Thus a portion of a stored set of linked events might comprise:

entry of an alarm technician's PIN within one hour disconnection of the mains; or within one hour shorting or open circuiting of a sensor, although this could be made more sophisticated to track the technicians location to the system processor or an actual sensor.

In any case, if either of the above mains or sensor events occurs, no alarm need sound whereas in conventional alarm panels an alarm would sound even if the panel were in standby mode.

EXAMPLE 4

For this example we assume that the property 12 has five occupants staying overnight. At 5.30 a.m. a minor fire is triggered by an electrical fault in one of the rooms 30. The fire is detected by the heat/motion sensor 16 (and optionally a smoke sensor (not shown)) in the room 30 in question. Clearly a fire related event will in general not be permitted and so this event will not match a stored set of linked events. Thus, an audible alarm sounds within the property 12 to wake the occupants. The audible warning of, for example, "fire detected in dining room—occupants detected in bedrooms 1, 2 and 3" is sounded. An immediate signal is sent via the cellular connection to the central monitoring station informing them of the fire and of the whereabouts of the persons staying in the property 12. The audible warning continues to sound in the property 12 until all occupants have left the property, or until the fire is extinguished.

It will also be seen from the above example, that the stored sets of linked events can include events which must happen if an alarm is not to be generated or if an alarm is to cease. Thus, a requirement after a fire event is triggered might be that movement is detected in the bedrooms where movement had been detected before the fire event.

As long as such a set of events has not happened, for example, if one of the occupants were sleeping through the alarm continuing warnings will sound. This would help warn the occupants that there were persons in the property 12 in potential danger. Once the rescue authorities have arrived at the scene they are updated as to the whereabouts of the occupants of the property 12, thus allowing them to be effective in their efforts of maintaining safety.

The present invention is not limited to the embodiments described herein, which may be amended or modified without departing from the scope of the present invention.

What is claimed is:

1. A system for monitoring an environment, said system comprising:

a plurality of sensors, each sensor generating respective events in response to activity in said environment;

a processor in operative association with the sensors, and at least one stored set of linked events accessible to said processor, wherein said processor is responsive to an event being generated by a sensor to determine whether the event is in a sequence of events corresponding to a stored set of linked events and wherein said system is responsive to the sequence of events not matching a stored set of linked events to generate an alarm.

2. A system as claimed in claim 1 wherein at least one of said plurality of sensors comprises an authorising sensor arranged to authenticate an individual's identity.

3. A system as claimed in claim 2 wherein at least one event in at least one of said at least one stored set of linked events includes authentication of an individual by said authorising sensor.

4. A system as claimed in claim 3 wherein said processor is adapted to track the location of any individual within the premises through matching a sequence of sensor events including said authentication event with a stored set of linked events.

5. A system as claimed in claim 3, wherein the environment comprises a premises having at least one entry point providing access from the exterior, and wherein said system includes a sensor associated with each entry point and which is operable to detect whether a door/window at the entry point has been opened, whereby the processor is arranged to generate an alarm unless a sensor associated with an access point generates an event in sequence with authentication of an authorised individual by said authorising sensor and matching a stored set of linked events.

6. A system as claimed in claim 5 wherein if access of an unauthorised individual through an open access point generates an event which is not in a sequence matching a stored set of linked events, the processor is operable to generate an alarm.

7. A system as claimed in claim 5, wherein the premises includes a plurality of rooms connected by interior doors, and wherein the system includes a sensor associated with each interior door, each sensor being operable to detect when the door has been opened or closed, and wherein at least one event in said at least one stored set of linked events includes a door opening.

8. A system as claimed in claim 5 wherein the plurality of sensors comprise heat and/or motion sensors, in addition to contact and/or vibration sensors in operative association with the door/window at any access point.

9. A system as claimed in claim 1 further including at least one video camera in operative association with the processor, such that on detection of an unauthorised individual, the processor activates a video camera so as to produce a video and/or audio recording of the unauthorised individual.

10. A system as claimed in claim 1 wherein the system comprises one or more signal generators in operative association with the processor, such that a signal can be provided to any authorised individual on the premises, detailing the location and/or number of unauthorised individuals in the premises.

11. A system as claimed in claim 1 wherein the system is connectable to an external monitoring station to which information can be transmitted from the system.

12. A system for monitoring an environment, the environment comprising a premises having at least one entry point providing access from the exterior, said system comprising:

a plurality of sensors, each sensor generating respective events in response to activity in said environment and including an authorising sensor arranged to authenticate an individual's identity and a sensor associated with each entry point and which is operable to detect whether a door/window at the entry point has been opened, a processor in operative association with the sensors, and at least one stored set of linked events accessible to said processor, wherein at least one event in at least one of said at least one stored set of linked events includes authentication of an individual by said authorising sensor, wherein said processor is responsive to an event being generated by a sensor to determine whether the event is in a sequence of events corresponding to a stored set of linked events and wherein the processor is arranged to generate an alarm unless a sensor associated with an access point generates an event in sequence with authentication of an authorised individual by said authorising sensor and matching a stored set of linked events.

13. A system as claimed in claim 12 wherein if access of an unauthorised individual through an open access point generates an event which is not in a sequence matching a stored set of linked events, the processor is operable to generate an alarm.

14. A system as claimed in claim 12, wherein the premises includes a plurality of rooms connected by interior doors, and wherein the system includes a sensor associated with each interior door, each sensor being operable to detect when the door has been opened or closed, and wherein at least one event in said at least one stored set of linked events includes a door opening.

15. A system as claimed in claim 12 wherein the plurality of sensors comprise heat and/or motion sensors, in addition to contact and/or vibration sensors in operative association with the door/window at any access point.

* * * * *